United States Patent [19]

Cucchiara

[11] 4,193,235

[45] Mar. 18, 1980

[54] AUXILIARY COVERING FOR A WINDOW

[76] Inventor: Philip M. Cucchiara, 17304 Winslow Rd., Shaker Heights, Ohio 44120

[21] Appl. No.: 915,398

[22] Filed: Jun. 14, 1978

[51] Int. Cl.[2] ..... E06B 3/26

[52] U.S. Cl. ..... 52/202; 52/222; 52/745; 160/380

[58] Field of Search ..... 52/202, 203, 222, 745; 160/380, 404, 378, 398, 380

[56] References Cited

U.S. PATENT DOCUMENTS

| | | | |
|---|---|---|---|
| 1,344,093 | 6/1920 | Shogren | 160/404 |
| 2,068,939 | 12/1962 | Commisso | 160/380 |
| 2,080,394 | 5/1937 | Ballantyne | 52/202 |
| 2,568,139 | 9/1951 | Behnke | 160/404 |
| 3,058,518 | 10/1962 | Housman | 160/380 |

FOREIGN PATENT DOCUMENTS

| | | | |
|---|---|---|---|
| 2287573 | 5/1976 | France | 52/202 |
| 317485 | 11/1969 | Sweden | 52/222 |

*Primary Examiner*—James L. Ridgill, Jr.
*Attorney, Agent, or Firm*—Oldham, Oldham, Hudak &Weber Co.

[57] ABSTRACT

The covering for a window has a pair of base and top or cap frame strips having complementary shaped engaging surfaces including longitudinally extending ribs and grooves, and where the base frame strip is adapted to be secured to a window frame casing or wall surface and such strip has a series of sharp pointed devices carried thereby and extending upwardly therefrom less than the thickness of the top frame strip so that a plastic sheet can be impaled on the sharp pointed devices and means secure the frame strips together and to the window frame in such a manner that the plastic sheet is in sealed engagement with and between the frame strips. The invention also includes the positioning of two plastic sheets over the window by use of an intermediate frame strip positioned between the top and base frame strips and the method of attaching the plastic sheets to the frame strip means which includes attaching one marginal edge of a plastic sheet onto one frame member by being impaled onto sharp devices thereon and then to be attached to the other frame members by grasping the plastic sheet and pulling it downwardly it is simultaneously tensioned laterally and is impaled onto the sharp devices on the other frame members. The sheet next is secured to such frame members or strips by cap strips to seal the plastic sheet in engagement with the frame strips under tension and form a substantially airtight cover over the window frame.

13 Claims, 17 Drawing Figures

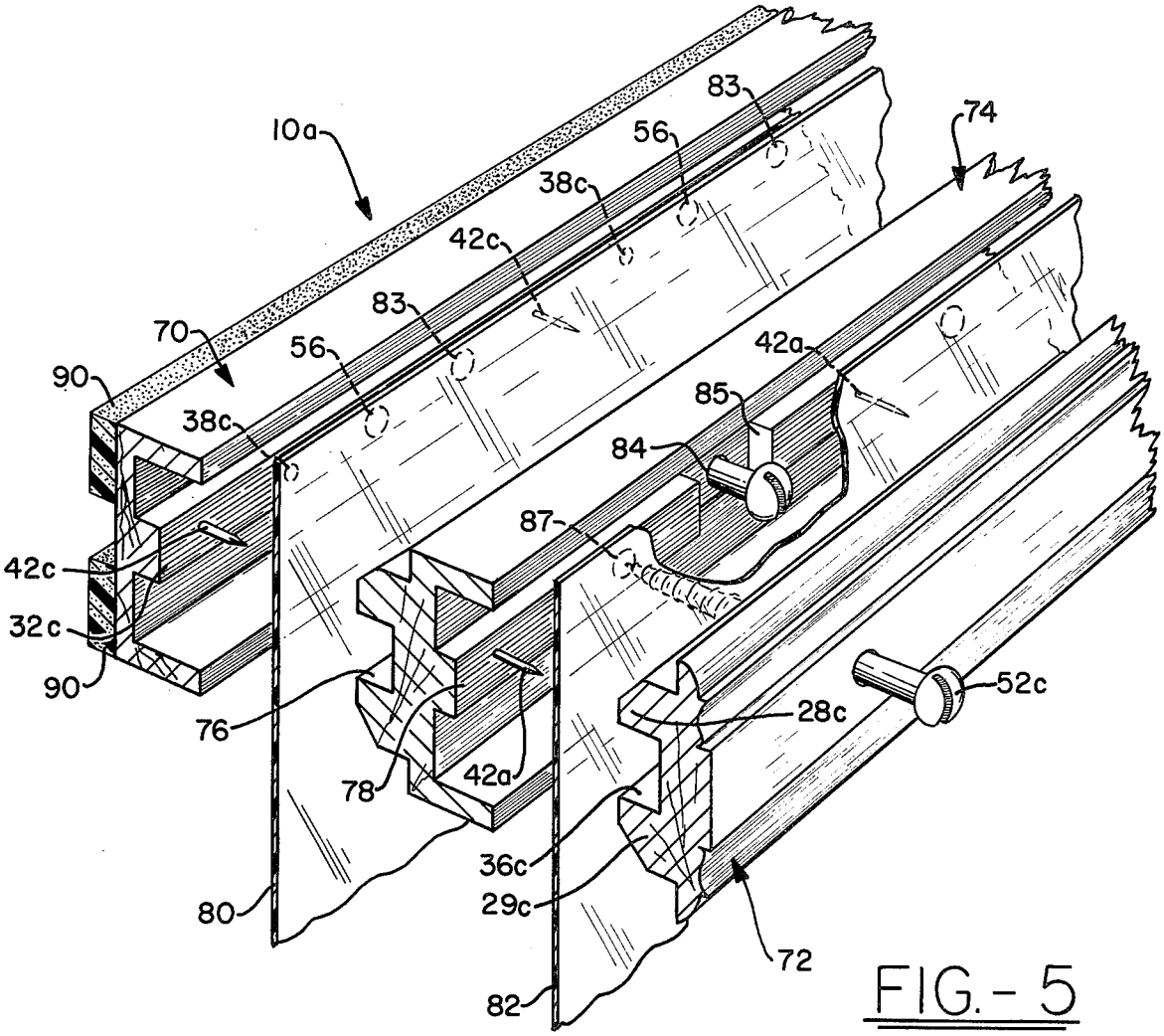
FIG.-5
FIG.-6
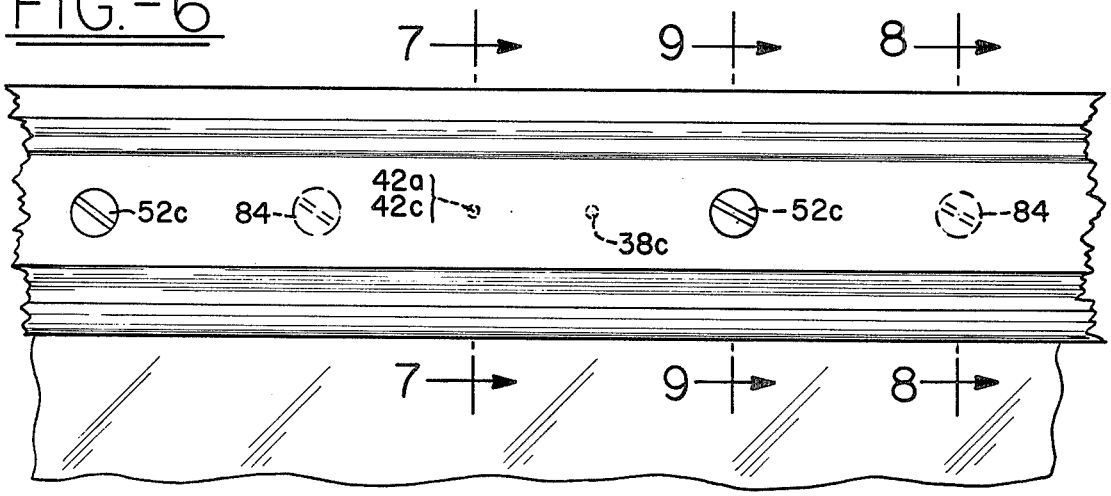

AUXILIARY COVERING FOR A WINDOW

BACKGROUND OF INVENTION

Heretofore there have been many, many different kinds of auxiliary coverings provided for windows, and many of such coverings are of the class of articles described as storm windows and which are secured, usually, to the outer surface of the window frames and are permanently affixed thereto. In some instances, people have provided just flexible plastic sheets attached over windows and window frame units for providing a sealing layer thereover and such plastic sheets have been positioned with a number of different crude devices or attaching strips at marginal portions of the plastic sheets.

It also has been proposed heretofore to attach a substantially rigid transparent plastic sheet to a window frame by use of substantially rigid plastic edge members that are suitably attached to the window frame and with such edging means or attaching units having interengaging rib means thereon whereby inwardly extending edge flanges on these attaching strips can be brought into engagement with each other and with the rigid plastic sheet positioned over the window opening. This plastic edge or positioning strip may be attached to the window frame by a cushioned adhesive attachment strip.

Thus, many types of plastic sheet covers that have been used heretofore have been relatively poorly made, or they have been quite unattractive in design or they have not been suitable for easy application to a plurality of different types of windows for low cost, but effective storm window protection for the windows.

Accordingly, it is the general object of the present invention to provide a new and improved auxiliary covering assembly for windows, and to provide these coverings or storm window attachment units made from attractive frame means that can be readily attached to the window frame to effectively position a plastic sheet in tensioned condition over a window and/or window frame for an auxiliary covering thereover.

Another object of the invention is to provide an auxiliary covering for a window that can be attached to a fixedly positioned window frame in which a window is movably positioned and wherein the covering material is provided on the inside surface of the window and building in which the window is located.

Yet another object of the invention is to provide a releasable type of frame means for plastic sheets and wherein the frame means will just bond or engage with the plastic sheets to form a seal therewith but which seal can be released and the frame members removed if it is desired to disassemble or remove the auxiliary window covering.

Another object of the invention is to provide an attachment frame means by which a low cost flexible plastic sheet can be used in a storm window assembly mounted either inside or outside of a building to seal the window in its associated building structure.

Yet other objects of the invention are to provide special frame strips for mounting auxiliary coverings over windows and wherein a pair of plastic sheets can be mounted in substantial parallel relation to each other over a given window; to provide relatively inexpensive but durable frame means for forming low cost but durable storm window construction systems; and to provide an effective, easily practiced method of assembly of protective sealed layers over a window frame unit.

The foregoing and other objects and advantages of the invention will be made more apparent as the specification proceeds.

Reference now is particularly directed to the accompanying drawings, wherein:

FIG. 5 is a fragmentary exploded perspective view of a modified embodiment of the auxiliary covering means of FIG. 1;

FIG. 6 is a fragmentary plan of the structure of FIG. 5;

Figures 1, 4:
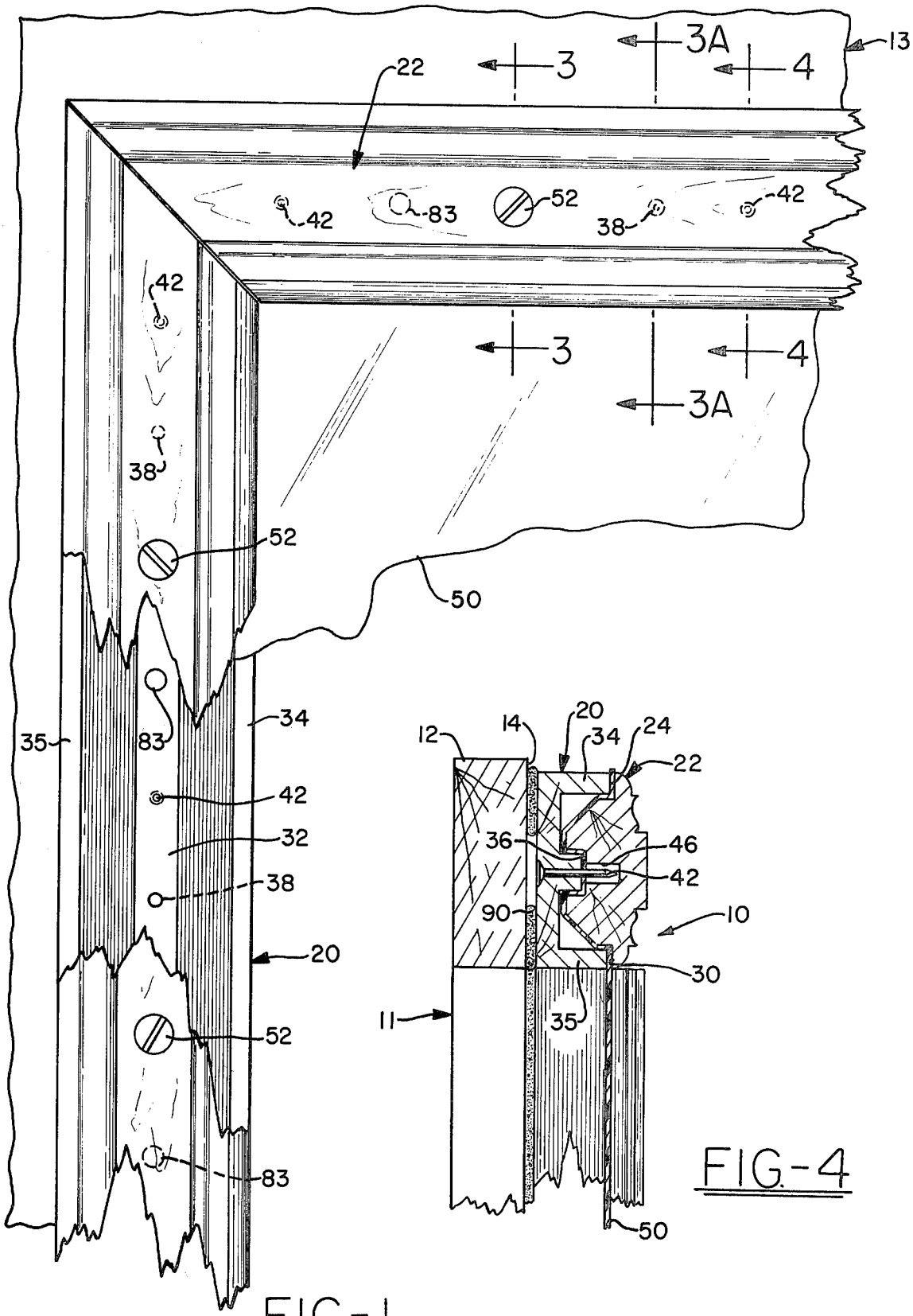
FIG. 1 is an elevation, partially broken away and shown diagrammatically, of a corner portion of an auxiliary window covering embodying the principles of the invention.
FIG. 4 is a fragmentary vertical section of the storm window or auxiliary cover means of FIG. 1 taken on line 4—4 thereof.
Figure 7:
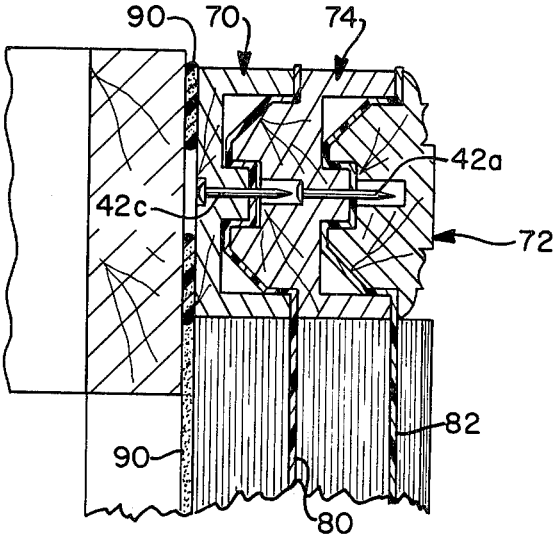
Figure 8:
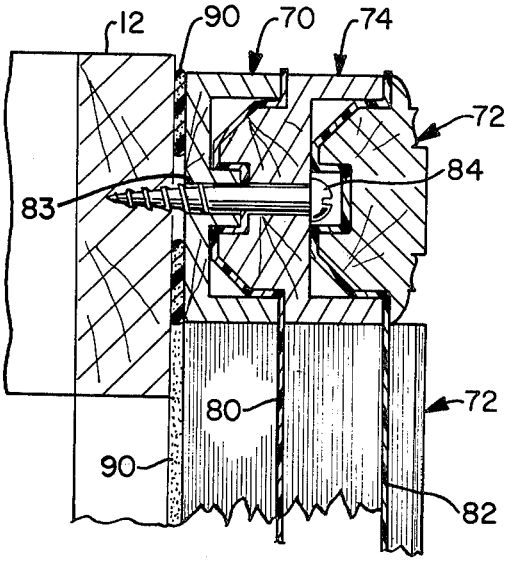
Figure 9:
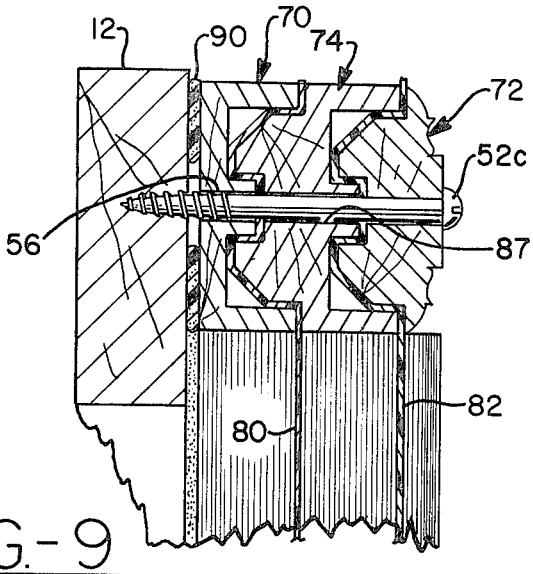
Figure 10:
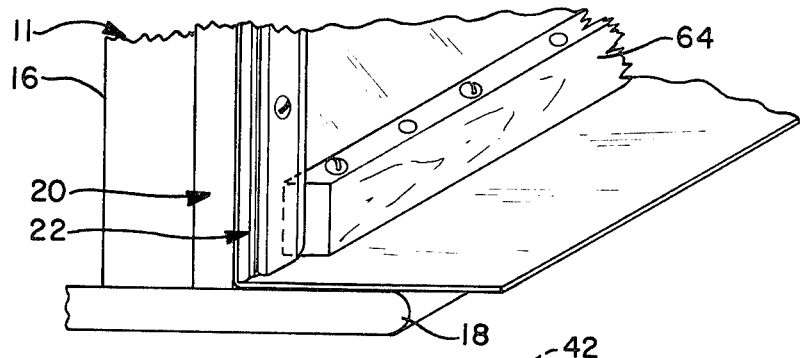
Figure 11:
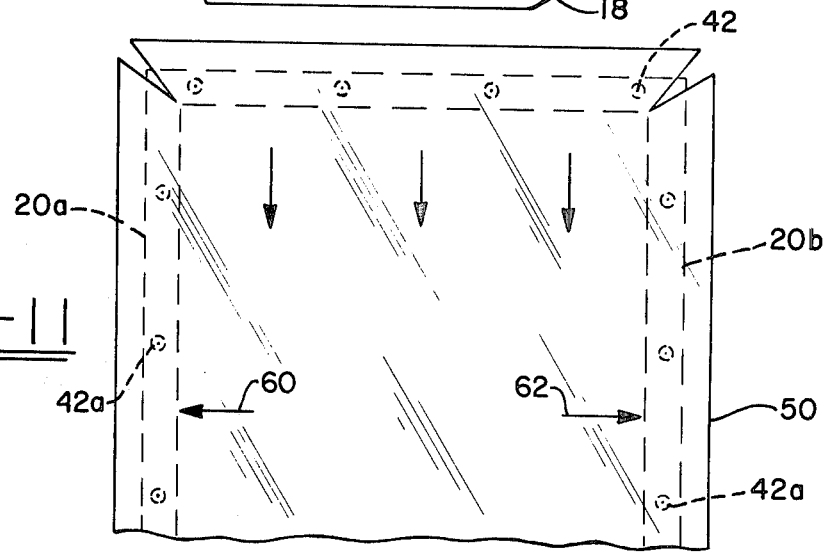
Figure 12:
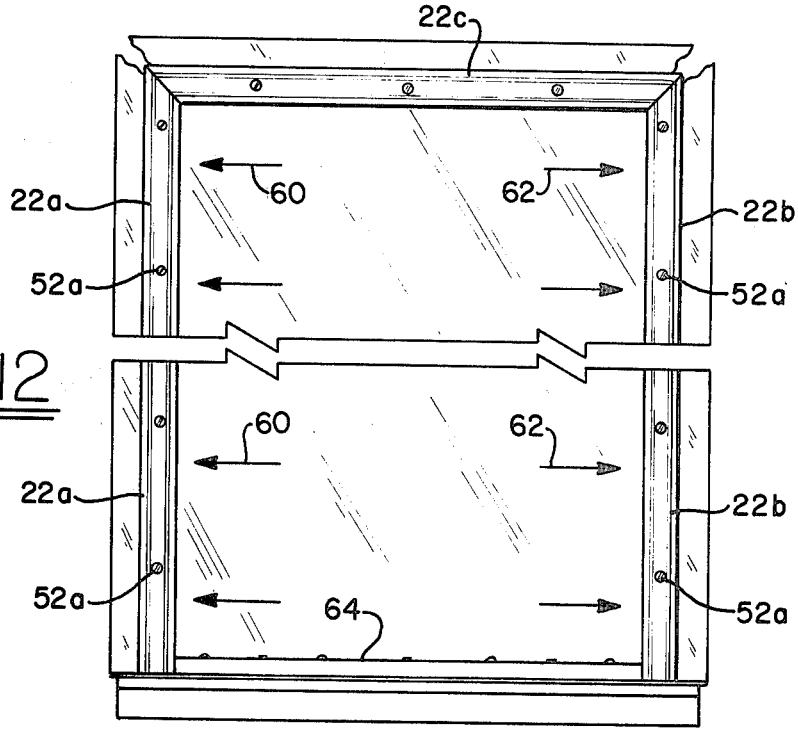
Figure 13:
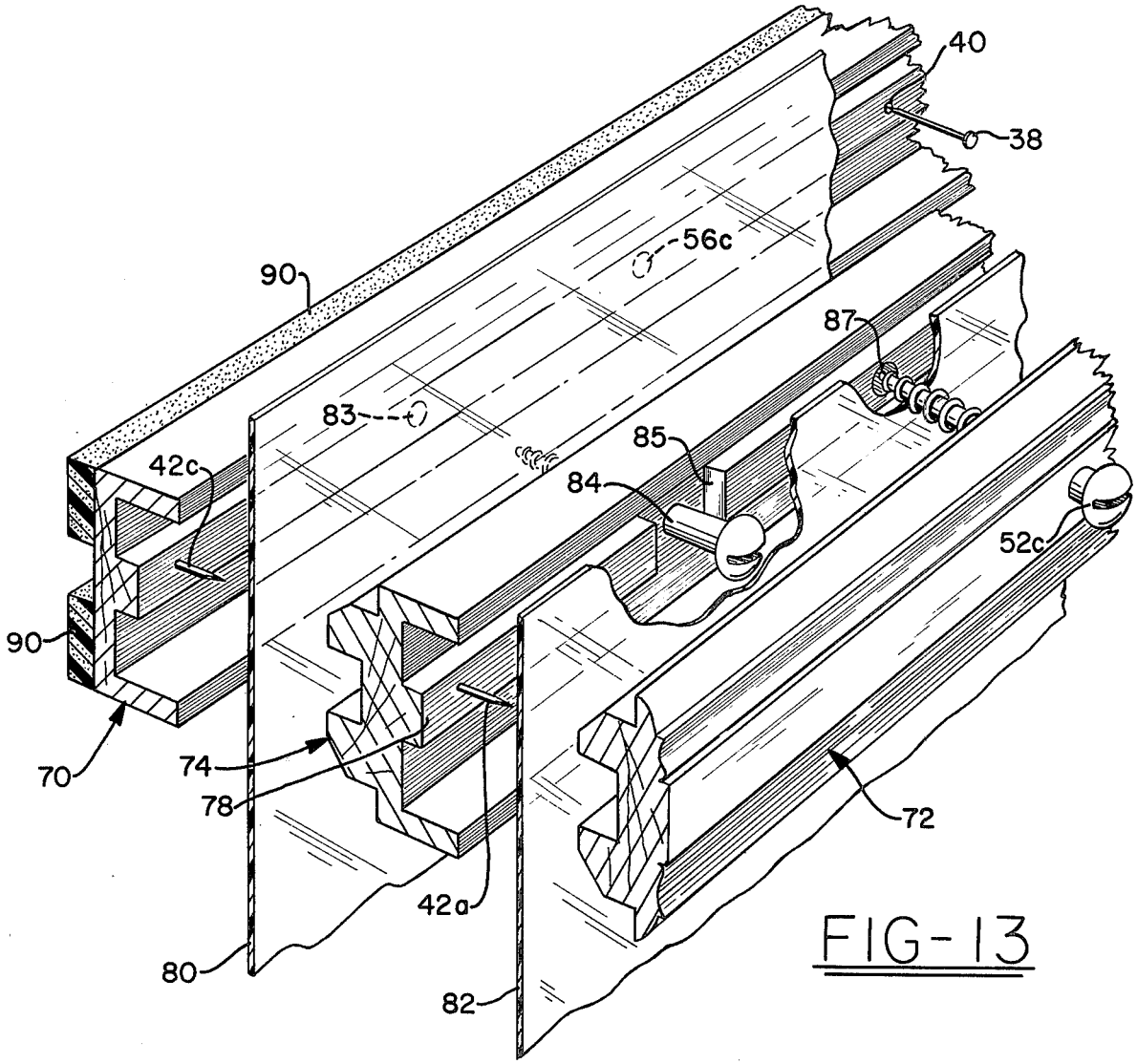
Figure 14:
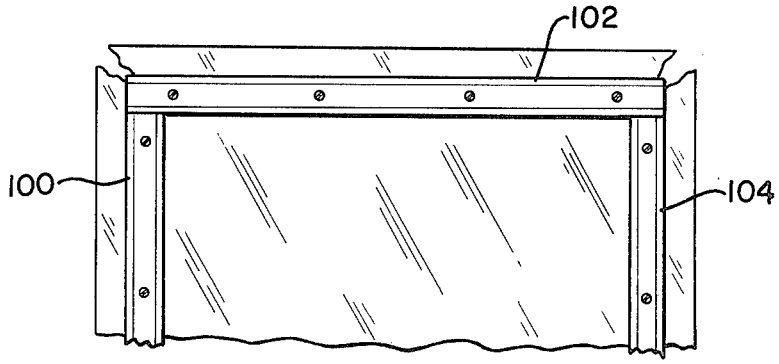

FIGS. 7, 8 and 9 are fragmentary vertical sections taken on lines 7—7; 8—8 and 9—9 of FIG. 6;

FIG. 10 is a fragmentary perspective view of a lower section of the auxiliary window covering of FIG. 1 and showing the window sill of the window frame;

FIG. 11 is a plan view, partially diagrammatic, showing the first step in applying a flexible plastic sheet to a window covering assembly as of the invention;

FIG. 12 is a further broken plan view indicating diagrammatically the action of tensioning the plastic sheet as it is assembled in the auxiliary window covering of the invention;

FIG. 13 is an exploded view of the entire two sheet seal assembly of the invention;

FIG. 14 is a fragmentary elevation of a modified frame assembly; and

Figure 15:
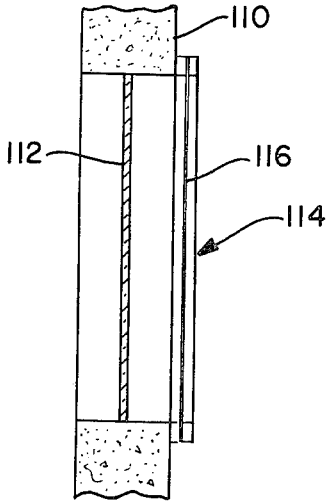
Figure 3A:
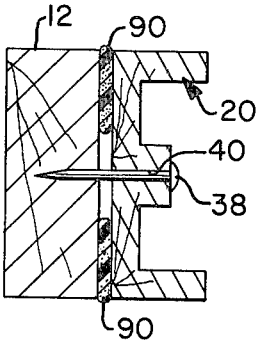
FIG. 3A is a vertical section of a base frame strip secured to a window frame.

FIG. 15 is a diagrammatic section of a modified window cover assembly of the invention.

When referring to corresponding members shown in the drawings and referred to in the specification, corresponding numerals are used to facilitate comparison therebetween.

SUBJECT MATTER OF INVENTION

This invention relates to an auxiliary covering, such as a storm window type of an article adapted to be positioned on a stationary window frame for covering the window assembly and which covering comprises a base frame strip and a top or cap frame strip that have complementary shaped superimposed engaging surfaces including longitudinally extending ribs and grooves, the base frame strip being adapted to be secured to a window frame casing, a wall or the like, the base frame strip having a series of sharp pointed devices carried thereby extending upwardly therefrom less than the thickness of the cap frame strip, a plastic sheet is provided and it is adapted to be impaled on the sharp pointed devices, and means are provided for securing the frame strips together and to the window frame, the plastic sheet is provided to be engaged by the adjacent complementary surfaces of the cap and bottom frame strips to be in sealed engagement therewith and be positioned thereby, a series of three or four pairs of frame strips being provided for top and side portions of the window frame, and usually an ordinary anchor strip is provided for securing a bottom portion of the plastic sheet to an associated window sill or the like whereby the plastic sheet can be tightly stretch across the window frame and form an airtight cover extending thereover.

Reference now is particularly directed to the accompanying drawings, wherein an auxiliary covering for a window is indicated as a whole by the numeral 10. This auxiliary covering 10 comprises an assembly from a plurality of components and the covering is especially adapted to be secured to the inside surface of a stationary window frame or a wall surface in a building. A portion of such stationary window frame is indicated in FIG. 4 and such portion comprises a window frame top or casing 12 indicated in FIG. 4, which frame member has a flat surface 14 facing inwardly into the interior of the building. The window frame assembly 11 also is indicated in FIG. 10 of the drawings, wherein the window frame assembly 11 is shown as having sides 16 and a bottom sill 18. Normally the surfaces of the sides 16 facing inwardly of the room likewise are flat like the top 12 and the sill 18 has a flat horizontally extending surface extending inwardly of the room as in conventional window frame assemblies.

FIGS. 1 through 4 of the drawings well show the auxiliary covering assembly of the invention and how it is secured in position. Thus, a base frame strip 20 and a top or cap frame strip 22 are provided and they have complementary shaped associated surfaces with a top surface 24 being provided on the base frame strip and a bottom surface 26 being provided on the top frame strip, such surfaces 24 and 26 having complementary shaped portions thereon including a pair of downwardly extending ribs 28 and 29 provided on the surface 26 of the top frame strip and which ribs are positioned laterally inwardly of the margins of the frame strip and terminate in flat shoulder portions 30 at each lateral margin of the strip. The complementary surface 24 on the base frame strip then comprises a center rib 32 and a pair of protruding shoulders 34 and 35 at the lateral margins of such base strip 20. FIG. 4 clearly shows that the shoulders 34 and 35 extend vertically upwardly from the remaining portions of the base frame strip an appreciable distance to engage with the flat surface shoulders 30 on the top frame strip, and that the center rib 32 on this base strip extends up into a center recess 36 formed on the top frame strip between the ribs 28 and 29.

The drawings clearly show that this center rib 32 is of generally rectangular shape in section and that the center recess 36 on the cap strip has a generally rectangular shape so that complementary surfaces are provided therebetween. Hence, a good airtight engagement can be provided between these strips 20 and 22 when operatively engaged in the auxiliary covering assembly of the invention.

Figure 2A:
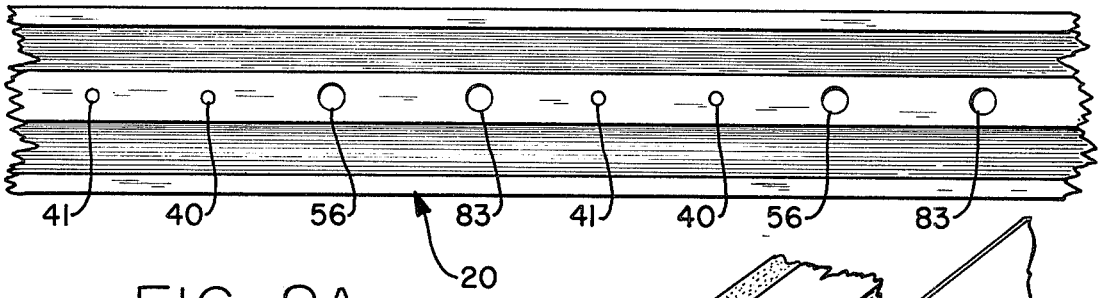
FIG. 2A is a fragmentary bottom plan view of a base frame strip.
Figure 2:
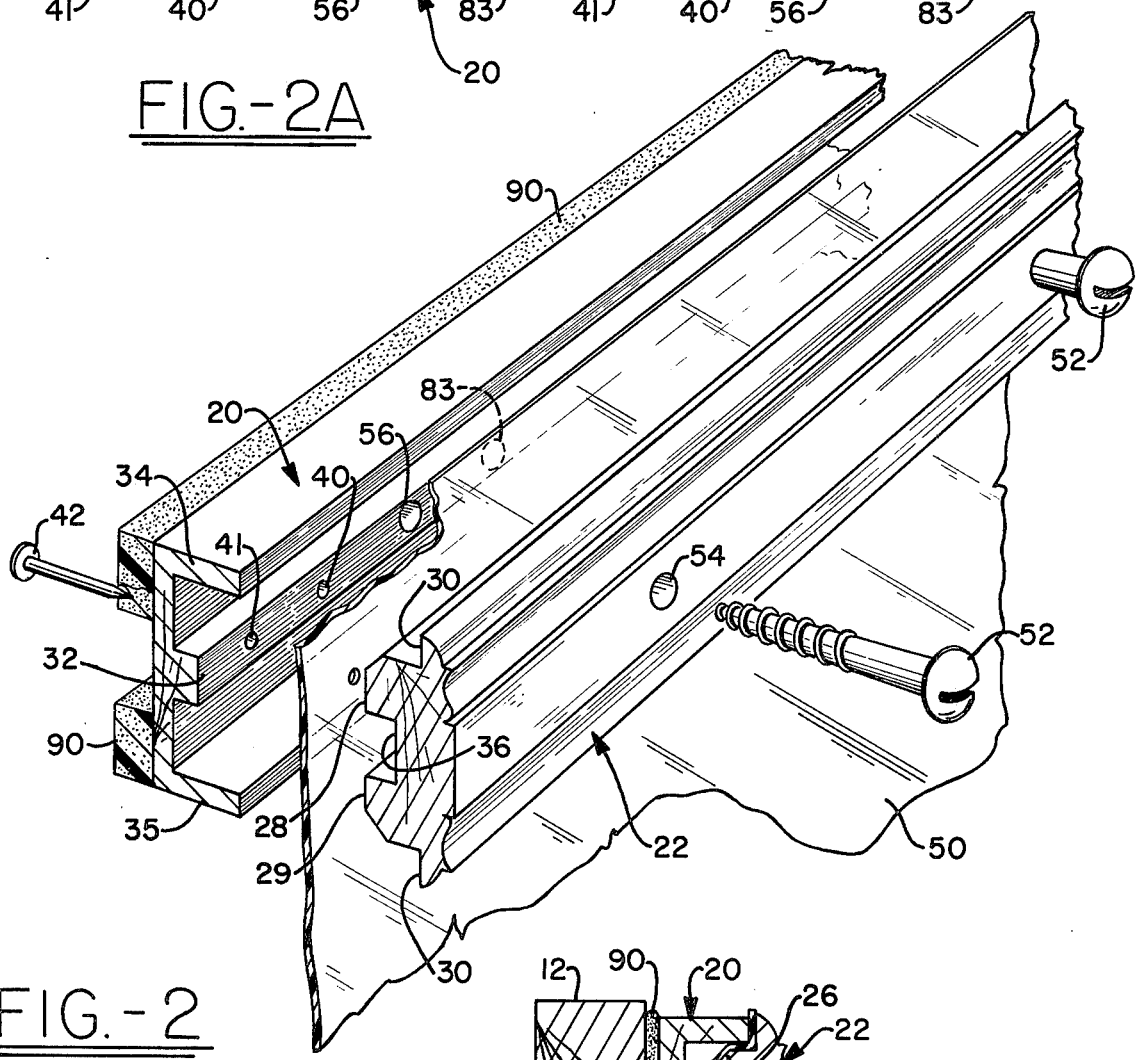
FIG. 2 is a perspective exploded view of a fragment of a frame strip means used in the window assembly.

Specifically, in order to provide ready mounting of the auxiliary covering on a window, I prefer to provide preformed holes 40 in the base frame strip 20, FIGS. 2A and 13, whereby nails 36 can be inserted in these holes 40 whereby the base strip can be nailed to the members forming the window frame to mount these base frame strips in position. As a feature of the present invention, there is also provided a plurality of holes 41 in the base frame strip at suitable longitudinal intervals thereof through which nails 42 can be pounded or forced from the bottom side of such base strip to extend upwardly therefrom a distance less than the effective thickness of the top frame strip 22. FIG. 4 best shows that this nail 42 can have its head recessed, if desired, on the base surface of the base strip and the nail extends up into a preformed hole 46 formed in the base of the center recess 36 in the top frame strip. By providing a plurality of these nails at adjacent or not widely separated portions of the base strip, I provide an effective means for anchoring or temporarily securing a plastic cover sheet 50 in the assembly. Thus, this plastic sheet, which may be made from soft, flexible plastic material such as vinyl, can be readily impaled on and engaged with the nails to be suspended therefrom or secured in position thereby and to aid in assembly of the total auxiliary covering of the invention.

Figure 3:
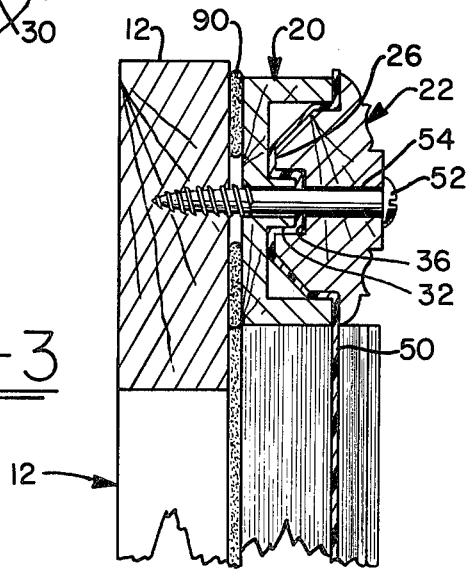
FIG. 3 is a vertical section taken on line 3—3 of FIG. 1 when the parts are in fully assembled relationship to each other.

Then to obtain an effective permanent engagement of one marginal portion of the auxiliary covering with the associated window frame 11, assembly screws 52 are inserted into preformed holes 54 in the cap strip which holes are aligned with preformed holes 56 in the base strip so that the final screw 52 can be operatively forced into and through the holes 54 and 56, and also naturally extend through the plastic sheet 50. Such screws are engaged permanently with the associated portion of the window frame means 11 whereby the cap frame strip 22 is brought into tight operative engagement with the base frame strip, as shown in FIG. 3. The shoulders 30 and 34 and 35 are tightly engaged with each other whereas the center rib 32 is also tightly engaged with the center recess 36 of the top frame strip, and the plastic sheet 50 is tightly secured between the top and base frame strips whereby an airtight assembly of this edge portion of the plastic sheet is obtained.

FIG. 11 shows the top and side base frame strips 20 secured to the window frame 11, and the plastic sheet is impaled on the nails 42 of the top strip. Next, the plastic sheet 50 can be pulled downwardly and then be manually tensioned laterally outwardly and be impaled on the nails 42*a* provided on the base frame strips 20*a* and 20*b*. Then cap frame strips 22*a*, 22*b* and 22*c* would be progressively equally attached to their associated base frame strips by attaching screws 52*a* as used in the assembly of the frame strips 20 and 22. Such action will pull the plastic sheet 50 upwardly and also laterally in the directions indicated by the arrows 60 and 62 as the center rib, and spaced ribs of the base and cap frame strips 22*a* and 20*a* are engaged with each other. The telescoping of the center ribs into the recesses in the associated frame strips draws the plastic sheet tight. At that time, the covering of the window frame 11 can be completed by nailing or screwing a sill strip 64 to the window sill 18 and trapping the lower edge of the plastic sheet 50 therebetween to anchor such portion of the plastic sheet in airtight association with the window frame. Thereafter, any trimming can be provided on the plastic sheet edges as is required. Such strip 64 lies in a plane with the cap strips 22*a* and 22*b* and it abuts against and extends between such strips with its inner surface against the sheet 50. Such sheet is taut and lies in a plane in the assembly.

Any portion of the plastic sheet protruding beyond the frame strips can be trimmed from the assembly whereby a low cost, but positive, airtight auxiliary covering assembly has been provided for covering the window frame 11. This auxiliary covering could be removed, when desired, or it can be left in position permanently, or it can be removed at one time and replaced at a later date.

The base and cap frame strips of the invention can be made from any suitable materials, wood, metal or plastic, and they are performed with sufficient holes therein that they can be readily secured in operative engagement with a window frame. The impaling and anchoring members in the assembly of the invention preferably are provided in these base and cap frame strips 20 and 22 prior to sale thereof so that a fully operative unit is provided and the person installing the auxiliary covering of the invention has only assembly and attaching operations to perform. Protruding corner areas can be cut from the plastic sheets at any suitable time to facilitate sealing sheet edges to the frame strips (FIG. 11).

A building wall 13 is indicated positioning the window frame 11 (FIG. 1).

Obviously the window cover assembly of the invention can be secured to the outer surface of the frame or building members outlining a window of a building.

DOUBLE SEAL EMBODIMENT

FIGS. 5 through 9 of the drawings clearly show a modification of the structure shown in FIGS. 1 through 4 wherein a multiple embodiment of an auxiliary covering assembly 10*a* of the invention is provided. In this instance, a base frame strip 70 is provided that is of the contour and general functioning the same as the base frame strip 20 and it has a top frame strip 72 identical with the cap frame strip 22 provided for operative association with such base frame strip and wherein impaling nails 42*c* are provided on the base frame strip, and a center rib 32*c* is provided on such strip. The top frame strip has a center recess 36*c* therein and associated ribs 28*c* and 29*c* as indicated in the drawings. In this instance, an auxiliary or center frame strip 74 is also provided in the assembly and it has a center recess 76 therein on one surface thereof like the recess 36 in the other member, and it receives the center rib 32*c* therein, whereas the opposite surface of such center frame strip has a protruding center rib 78 on its opposite face and this is like the center rib 32 and is received in the center recess 36*c* of the associated top frame strip. Accordingly, a pair of plastic sheets 80 and 82 are provided to be impaled on the nails 42*c* extending up from the bottom or base strip member and to be impaled on the second series of nails 42*a* carried by the intermediate or center frame strip 74 and then to be locked in position between the complementary formed rib and groove surfaces on the three frame strip means of the invention.

Normally the base frame strip can be secured in position as in the other embodiment of the invention and the auxiliary center frame strip 74 is secured in place by spaced screws 84 extending through holes 83 in the base strip and then the final attaching screw 52*c* can be used to secure all members in place. The screw 52*c* extends through a preformed hole in the cap strip and a hole 87 in the center strip and the hole 56*c* in the base strip.

It will be realized that the pattern and spacing of the holes 40, 41, 56 and/or of other series of holes in the cap strip or center strip all are repetitive lengthwise of the strips. Hence, the strips are cut at corresponding portions thereof to obtain a frame means of a desired size with the holes or recesses, etc., in the different strips being properly aligned in assembly.

FIG. 14 shows how the frame components 100, 102 and 104 may have butt joints formed therebetween, and such frame components otherwise are the same as shown in FIGS. 1–4 of the drawings.

FIG. 15 has a building wall 110 with a window 112 positioned in a window opening spaced from the wall surface. In such instance, a window seal assembly 114 of the invention is secured to the flat surface of the wall. Such assembly would comprise four pairs of the base and cap frame strips engaging and positioning a plastic seal sheet 116.

The components of the structures shown in the drawings, and especially those shown in FIGS. 5 through 9 can be made of any suitable thickness. Thus, the center frame strip 74 preferably would be formed in one piece and size to correspond to the depth of the ribs and grooves formed in the associated frame means.

The base frame units of the invention may be sealed in place on the casing by flexible foam adhesive coated gasket strips, as desired. Or, resilient cushion foam sealing strips 90 can be secured to the flat back of the base frame strip for sealing action.

From the foregoing, it is submitted that a novel and improved auxiliary covering assembly has been provided for windows. This covering assembly is removable and can be put in position and taken down with the seasons, as desired. All components of the unit can be reused. Any conventional transparent plastic sheet can be used in the window and a flexible plastic is desired. The apparatus is effective and economical whereby the objects of the invention have been achieved.

While several embodiments of the invention have been disclosed herein, it will be appreciated that modification of these particular embodiments of the invention may be resorted to without departing from the scope of the invention.

What is claimed is:

1. An auxiliary covering for a window positioned in a stationary window frame and comprising:

a base frame strip and a top frame strip having complementary shaped engaging surfaces including at least one longitudinally extending rib and groove on the different strips, said base frame strip having a back surface adapted to be positioned on a window frame, wall surface or the like, said base frame strip having a series of nails extending therethrough from its back surface and protruding upwardly from the strip less than the thickness of said top frame strip, a plastic sheet having an edge length thereof impaled on said nails, and means securing said frame strips together, said plastic sheet being in sealed engagement with and between said frame strips, said top frame strip having an inner surface contacting said plastic sheet and one or more openings in such inner surface for receiving the upper ends of said nails, said base frame strip being secured to the window frame.

2. An auxiliary covering as in claim 1, where said base strip has two flat surfaced shoulder portions extending the length of such strip and said top strip has two flat surfaced edge flanges for engaging said base strip shoulder portions and compressing said plastic sheet therebetween, and said nails on said base strip are positioned in alignment in a row between said two flat surfaced shoulder portions, said top strip and said base strip sealing said plastic sheet therebetween on both sides of said row of nails.

3. An auxiliary covering as in claim 1 where a flat back surface is provided on said base frame strip and it lies against an edge strip of the window frame, and screws secure said top frame strip to said bottom frame strip and to the window frame whereby a removable covering can be provided for the window by the flexible plastic sheet.

4. An auxiliary covering as in claim 1 where said rib and groove is so sized and shaped as to telescope into engagement with said plastic sheet being received therebetween so as to be in at least substantially airtight engagement therewith.

5. An auxiliary covering as in claim 1, where a plurality of said base frame strips are provided and are secured to a window frame unit having flat members on the axially inner part of said window frame unit, and resilient sealing means are present between said base frame strips and said flat members.

6. An auxiliary covering as in claim 1 where a center frame strip is provided and it has a bottom surface complementary to said engaging surface of said base frame strip and a top surface complementary to said engaging surface of said top frame strip, and two plastic sheets can be positioned over the window by positioning a plastic sheet in engagement with each said surface of said center frame strip, but where said center frame strip is omitted when only one plastic sheet is to be positioned but with complementary rib and groove means engaging to form a tight seal irrespective of whether or not said center frame strip is present.

7. An auxiliary covering as in claim 6, where said base frame strip, said top frame strip, and said center frame strip have repetitive series of longitudinally spaced holes therein for receiving means for securing said center frame means to said base frame strip and to a support; for securing said top frame strip to said center frame strip, base frame strip and a support; or for securing said top frame strip to said base frame strip and a support.

8. An auxiliary covering and assembly as in claim 6, where said sill frame strip is present and it is adapted to be secured to a window sill, said sill frame strip extending between said side frame strips and being laterally aligned therewith.

9. An auxiliary covering as in claim 6 where said frame strips are provided with a repetitive series of openings or holes therein for receiving attaching, impaling or securing members therein to facilitate operative assembly of said strips.

10. A method for attaching a storm window covering over a window frame comprising attaching a frame strip having upstanding sharp members protruding therefrom to the top of the window frame, impaling a marginal portion of a plastic sheet onto said sharp members of the top frame strip, securing said marginal portion of the plastic sheet to the top frame strip by applying a cap strip to the top frame strip, attaching two similar side frame strips having upstanding sharp members thereon to two side margins of the window frame, manually tensioning said plastic sheet downwardly and laterally outwardly, impaling a pair of opposed edge portions of said plastic sheet when tensioned onto said two side frame strips, and securing opposed edge portions of said sheet to said side frame strips by cap frame strips which have interengaging longitudinally extending ribs and grooves therein that engage said sheet to draw it laterally outwardly.

11. A method of attaching a storm window as in claim 9 where elongate base and cap frame strips are provided and a repetitive pattern of longitudinally spaced holes are formed therein so that such strips can be cut to the length desired and be assembled in pairs of base and cap strips with holes therein aligned for operative use of said strips.

12. An auxiliary covering for a window positioned in a stationary window frame and comprising:

a base frame strip and a top frame strip having complementary shaped engaging surfaces including longitudinally extending ribs and grooves, said base frame strip being adapted to be secured to a window frame, wall surface or the like, said base frame strip having a series of sharp pointed devices therein extending upwardly therefrom less than the thickness of said top frame strip, a plastic sheet having an edge length thereof impaled on said devices, means securing said frame strips together and to said window frame, said plastic sheet being in sealed engagement with and between said frame strips, a center frame strip is provided and it has a bottom surface complementary to said base frame surface and a top surface complementary to said top frame surface, and two plastic sheets can be positioned over the window by positioning a plastic sheet in engagement with each said surface of said center frame strip, and said center frame strip has upwardly extending nails thereon extending up less than the thickness of said top frame strip for engaging a plastic sheet impaled thereon.

13. A auxiliary covering as in claim 12 where a flat back surface is provided on said base frame strip and it lies against an edge strip of a window frame, and holes are formed in said top frame strip and in said center strip to receive the nails protruding from the adjacent frame strip.

* * * * *

UNITED STATES PATENT OFFICE

CERTIFICATE OF CORRECTION

Patent No. 4,193,235 Dated March 18, 1980

Inventor(s) Philip M. Cucchiara

It is certified that error appears in the above-identified patent and that said Letters Patent are hereby corrected as shown below:

In Column 8, line 18, "9" should be --10--.

Signed and Sealed this

*Tenth* Day of *June 1980*

[SEAL]

*Attest:*

SIDNEY A. DIAMOND

*Attesting Officer* *Commissioner of Patents and Trademarks*